US006428338B1

(12) United States Patent
Yasufuku et al.

(10) Patent No.: US 6,428,338 B1
(45) Date of Patent: Aug. 6, 2002

(54) CONNECTOR WITH SLIDE AND LEVER

(75) Inventors: Kaori Yasufuku; Taiji Hosaka, both of Yokohama; Masaaki Miyazawa, Kawasaki, all of (JP)

(73) Assignee: J.S.T. Mfg. Co., Ltd. (JP)

( * ) Notice: Subject to any disclaimer, the term of this patent is extended or adjusted under 35 U.S.C. 154(b) by 0 days.

(21) Appl. No.: 09/690,463

(22) Filed: Oct. 18, 2000

(30) Foreign Application Priority Data

Oct. 18, 1999 (JP) ..... 11-295228

(51) Int. Cl.[7] ..... H01R 13/62
(52) U.S. Cl. ..... 439/310; 439/680; 439/157
(58) Field of Search ..... 439/310, 157, 439/680, 325, 159, 364; 361/685, 686, 683

(56) References Cited

U.S. PATENT DOCUMENTS

| | | | | |
|---|---|---|---|---|
| 4,887,188 A | | 12/1989 | Yoshida et al. | |
| 5,207,598 A | * | 5/1993 | Yamada et al. | 439/636 |
| 5,286,214 A | | 2/1994 | Takahashi | |
| 5,325,263 A | * | 6/1994 | Singer et al. | 361/683 |
| 5,483,419 A | * | 1/1996 | Kaczeus, Sr. et al. | 361/685 |
| 5,581,127 A | | 12/1996 | Shinohara | |
| 5,689,405 A | | 11/1997 | Bethurum | |
| 6,186,804 B1 | * | 2/2001 | Smith | 439/157 |

FOREIGN PATENT DOCUMENTS

| | | | | |
|---|---|---|---|---|
| JP | 62015781 | * | 1/1987 | H01R/13/629 |
| JP | 5-211076 | | 8/1993 | |
| JP | 7-122057 | | 5/1995 | |
| JP | 8-102346 | | 4/1996 | |
| JP | 8-250211 | | 9/1996 | |

* cited by examiner

*Primary Examiner*—Gary F. Paumen
*Assistant Examiner*—James R. Harvey
(74) *Attorney, Agent, or Firm*—Connolly Bove Lodge & Hutz LLP

(57) ABSTRACT

A connector of the invention includes a main body; a terminal, arranged at the main body, to be electrically connected with a connection object having at least one uneven part; and an auxiliary member mounted on the main body and having at least one fitting part to fit to the respective of the at least one uneven part of the connection object. According to the invention, when the uneven part varies in location and/or configuration in accordance with the types of the connection objects used, only the connection object having the uneven part corresponding in location and/or configuration to the fitting part formed in the auxiliary member can be loaded onto the connector to prevent erroneous loading of the connection object. Also, by eliminating all of the fitting parts from the main body and arranging them on the auxiliary member, or by eliminating the fitting part to fit to the uneven part that varies in location and/or configuration in accordance with the types of the connection object from the main body and arranging them on the auxiliary member and also arranging the remaining fitting part that remains unchanged in location and configuration regardless of the types of the connection object on the main body, the structure of the main body can be shared with different types of connection objects. This can allow the connector to accommodate two or more types of connection objects by simply replacing the auxiliary member.

2 Claims, 11 Drawing Sheets

CONNECTOR WITH SLIDE AND LEVER

BACKGROUND OF THE INVENTION

1. Technical Field of the Invention

The present invention relates to a connector for electrically connecting a connection object, such as a memory module, to a terminal and, more particularly, to a connector having the ability to prevent erroneous loading of the connection object.

2. Description of the Prior Art

Of expansion memory module connectors of personal computers or the like, some are provided with latches for fixedly holding the memory module at end portions of two arms extending from opposite ends of its housing. The latches have protrusions to be engaged in cutouts provided at both sides of the memory modules and ears for the latches to be moved laterally outwardly.

When the memory module is loaded to the connector having these latches, the memory module is inserted in the connector at a predetermined angle until contacts on the connector and conductive pads on the memory module are brought into contact with each other and then the memory module is tilted down toward the connector. Then, the protrusions of the latches and the cutouts of the memory module are engaged with each other and thereby the memory module is fixed to the connector. When the memory module is released or unloaded from the connector, a user have to pull out the memory module from its loaded position, manipulating the ears to move the latches in a direction of being laterally spaced from each other.

By the way, there are several variations of expansion memory modules of personal computers which are identical in the entire form but different in operating voltage and others. If an inappropriate memory module is erroneously loaded onto the connector, that will be the cause of trouble of the memory module itself and the personal computer. Accordingly, the erroneous loading prevention technique prevails that a recess (which is generally called "a key slot") is formed in the memory module that differs in position in accordance with types, while also a protrusion (which is generally called "a key") to fit in the recess on the memory module is formed in the connector at an appropriate position in accordance with the types of the memory module used, to prevent erroneous loading of an inappropriate memory module onto the connector. In general, the protrusion on the connector is integrally molded with the housing.

According to the above-noted erroneous loading prevention technique for the memory module, if the occasion arises that a memory module must be replaced with a different type of memory module, then the recess on the memory module and the protrusion on the connector will not correspond in fitting position to each other and, as a result, the whole connector will have to be replaced with another one having the protrusion to fit in the recess in that memory module. The connector is usually fixed to a motherboard and the like, so that the replacement must be done with onerous and complication task.

In addition, according to the conventional technique noted above, in the case where two or more recesses are arranged on the memory module, the protrusions of equal in number to the recesses must be arranged on the housing so that the protrusions paired with the recesses can all be fitted into the related recesses. The more the number of protrusions increases, the more precisely the housing must be manufactured so that the positional error of the protrusions can be prevented. Also, the onerous and complication task is then involved that the memory module must be aligned so that the recesses on the memory module and the protrusions on the housing can all simultaneously fitted to each other, when the memory module is loaded to the connector.

SUMMARY OF THE INVENTION

Accordingly, it is a primary object of the present invention to provide a connector having the ability to prevent erroneous loading of a connection object that enables the loading of two or more different types of connection objects such as memory modules to a connector with relatively simple work without the need for replacement of the whole connector.

It is a further object of the present invention is to provide a connector having the ability to prevent erroneous loading of a connection object that can permit a relatively simple alignment of the connection object without requiring high manufacturing accuracy for the housing, even when two or more recesses are arranged on the memory module.

One aspect of the invention is directed to a connector for electrically connecting a connection object and a terminal, the connector comprising a main body; the terminal, arranged at the main body, to be electrically connected with the connection object having at least one uneven part; and an auxiliary member mounted on the main body and having at least one fitting part to fit to the respective of the at least one uneven part of the connection object.

According to the present invention, since the auxiliary member having the at least one fitting part to fit to the at least one uneven part formed in the connection object is mounted on the main body, when the at least one uneven part varies in location and/or configuration in accordance with the types of the connection objects used, only the connection object having the uneven part corresponding in location and/or configuration to the fitting part formed in the auxiliary member can be loaded onto the connector to prevent erroneous loading of the connection object.

Also, by eliminating all of the fitting parts to fit to the uneven parts formed in the connection object from the main body and arranging them on the auxiliary member, or by eliminating the fitting part to fit to the uneven part that varies in location and/or configuration in accordance with the types of the connection object from the main body and arranging them on the auxiliary member and also arranging the remaining fitting part that remains unchanged in location and configuration regardless of types of the connection object on the main body, the structure of the main body can be shared with different types of connection object. This can allow the connector to accommodate two or more types of connection objects by simply replacing the auxiliary member.

It should be noted that the term "uneven part" as used in the present invention is intended to mean parts having non-flat surface form, such as recesses, protrusions, cutouts, projections, holes, slots and the like formed in the surface of the connection object, including all the non-flat parts formed by two or more flat surfaces, at least one curved surface, or, combination of the flat surfaces and curved surface. The term "fitting part" as used in the present invention is intended to mean parts having a configuration to fit to the above-mentioned "uneven part", including all the non-flat parts. The fitting part is unnecessarily required to have an accurate configuration to snugly fit to the uneven part.

Preferably, the connector of the invention further comprises an operating member, which may be manually operated by a user, mounted on the main body to be associated therewith, and the auxiliary member is adapted to detachably support the connection object and to move reciprocally relative to the terminal in association with movement of the operating member.

With this arrangement, since the auxiliary member that moves reciprocally relative to the terminal in association with the movement of the operating member can detachably support the connection object, the electrical connection between the terminal and the connection object is achieved by moving the auxiliary member after the fitting engagement of the uneven part of the connection object and the fitting part of the auxiliary member has completed. In other words, the connection between the terminal and the connection object is not made until after the precise alignment is achieved by the fitting engagement of the uneven part and the fitting part. This can ensure the reliable connection between the terminal and the connection object.

Also, since the connection object is connected to the terminal by moving the operating member after the connection object is supported on the auxiliary member in the non-connected state, a user can simply switch between the connected mode and the non-connected mode of the connection object in a simple manner by the operation of the single operating member. Also, there is no need for a user to directly touch the connection object when the connection object is switched between the connected mode and the non-connected mode, so that local application of an excessive force to the connection object or the connector can be avoided and, thus, the damage or deformation of these components can be prevented.

It is preferable that in the connector of the invention, two or more fitting parts to fit to their related two or more uneven parts formed in the connection object are separately arranged so that each of the main body and the auxiliary member has at least one fitting part.

With this arrangement in which two or more fitting parts are separately arranged so that each of the main body and the auxiliary member has at least one fitting part, after the fitting engagement of the uneven part of the connection object and the fitting part of the auxiliary member has completed, the auxiliary member is moved so that the fitting engagement of the uneven part of the connection object and the fitting part of the main body can be achieved. As a result of this, it is only necessary for supporting the connection object to the auxiliary member to align the connection object so that the fitting engagement of a part of the uneven part of the connection object and the fitting part of the auxiliary member can be achieved. Also, before the fitting engagement of the remaining uneven part of the connection object and the fitting part of the main body, the connection object is already put in the state of being aligned and supported on the auxiliary member. Thus, that fitting engagement can be achieved without the need for any additional alignment of the connection object. In short, the fitting engagements of two or more uneven parts and two or more fitting parts are achieved in two separate steps, whereby the immediate and smooth fitting engagements of the uneven parts and the fitting parts is ensured.

Also, the fitting parts are separated and then arranged on each of the main body and the auxiliary member and, thus, the uneven parts formed in the main body and the fitting parts formed on the auxiliary member both become smaller in number than the uneven parts formed in the connection object. This can produce the advantage that the fitting engagement of all pairs of uneven parts and fitting parts can easily be achieved without requiring high degree of manufacturing accuracy for the main body and the auxiliary member such that each of the fitting parts can accurately be set in position.

It is to be noted that the uneven parts and the fitting parts are not necessarily required to have an identical configuration among themselves. For example, when the two fitting parts are formed, those two fitting parts may be different in configuration from each other.

Further, the term "connection object" as used in the present invention is intended to include electronic modules in which electronic chips are arranged in a card-like substrate, cells (whichever their types, dry cells, button cells, etc.), fuses and various kinds of cards (CF card, MMC, Smart media, SIM, and PCMCIA card), in addition to the memory modules. Any of them can be used as the connection object, as long as it is electrically connectable with the terminal arranged on the connector side.

Other and further objects, features and advantages of the invention will appear more fully from the following description taken in connection with the accompanying drawings.

BRIEF DESCRIPTION OF THE DRAWINGS

FIG. 6(*b*) is a side elevation view of the same, showing the state of the cover being closed;

FIG. 8(*b*) is a sectional view of the same, showing the state of the cover being closed;

DESCRIPTION OF THE PREFERRED EMBODIMENT

Figure 1:
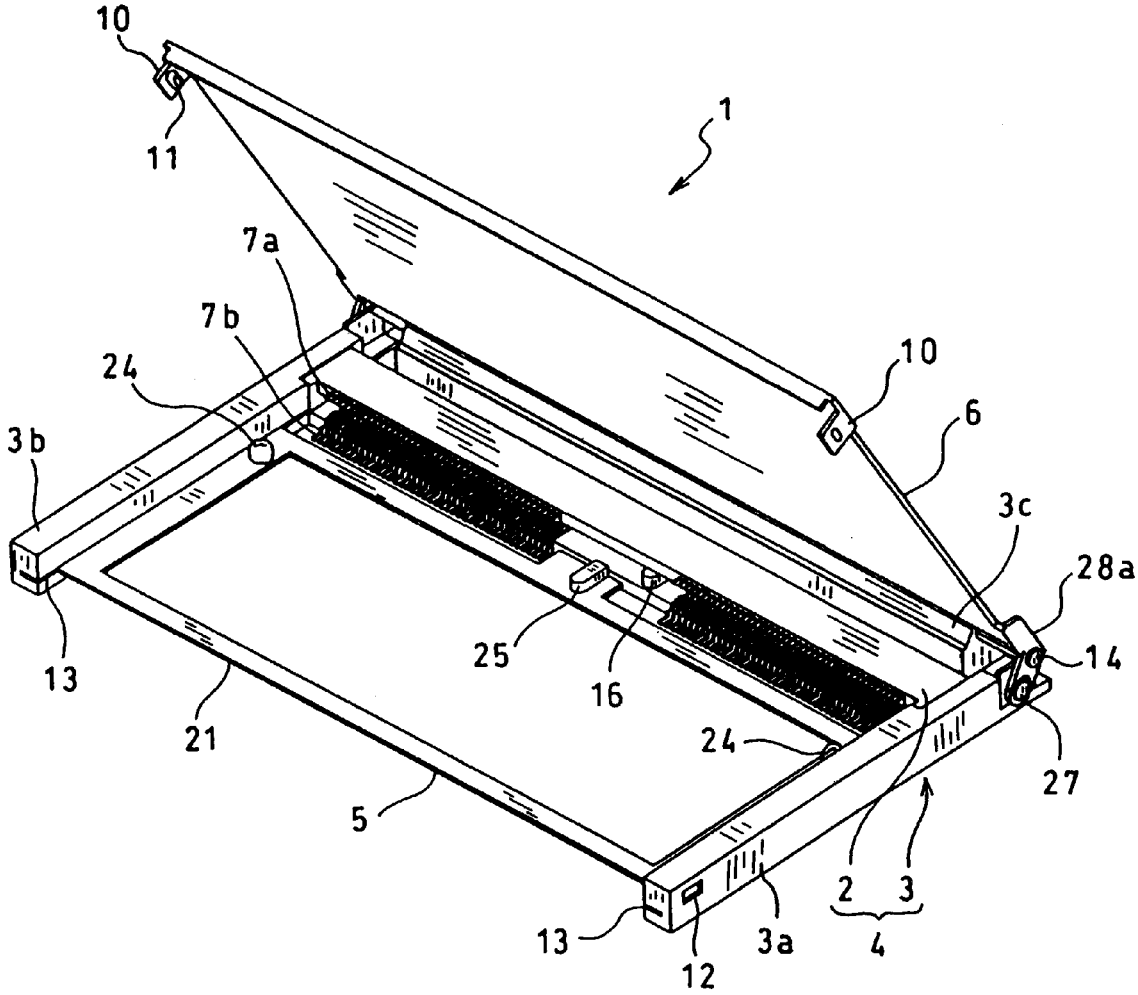
FIG. 1 is a perspective view of a connector according to the first embodiment of the invention to which a memory module for a notebook-size personal computer is loaded, showing the state of its cover being opened.
Figure 2:
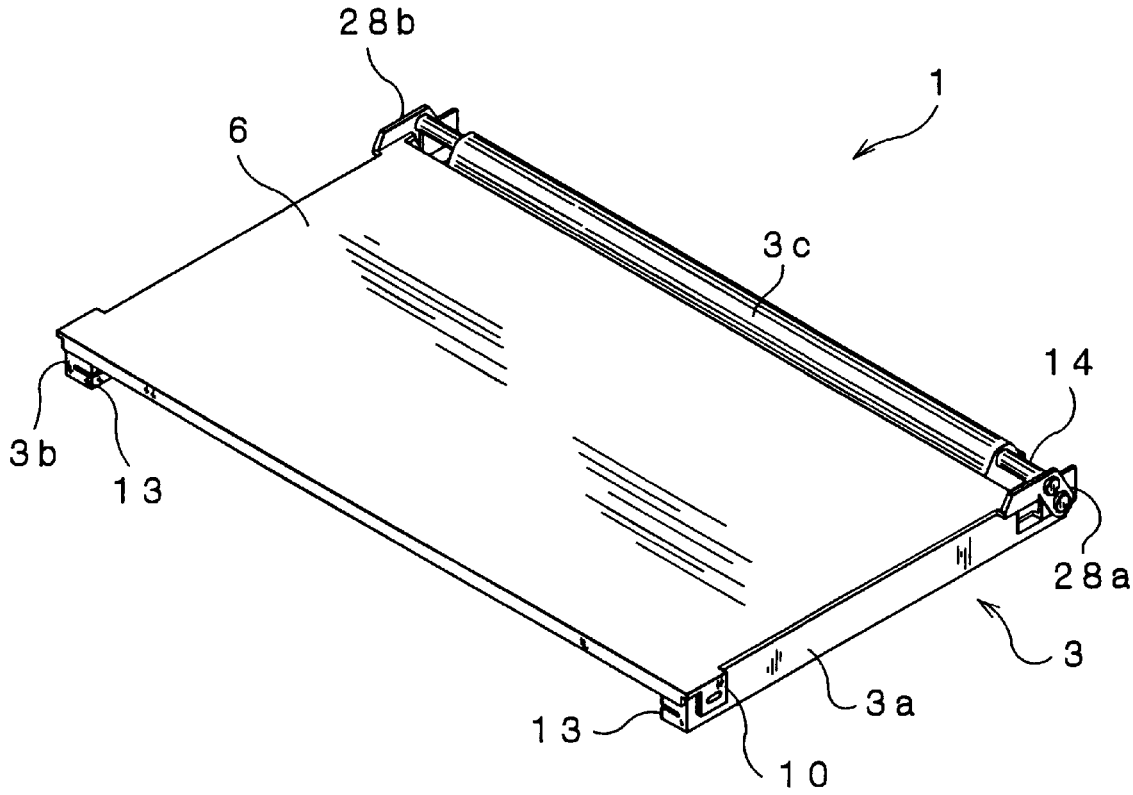
FIG. 2 is a perspective view of the connector of FIG. 1, showing the state of the cover being closed.

A connector 1 of the embodied form shown in FIGS. 1 and 2 has a main body 4 comprising a housing 2 and a base 3, a slider 5 (an auxiliary member) mounted on the base 3 in such a manner as to be reciprocally sidable away from and toward the housing 2, and a cover 6 rotatably mounted on the base 3.

Figure 3:
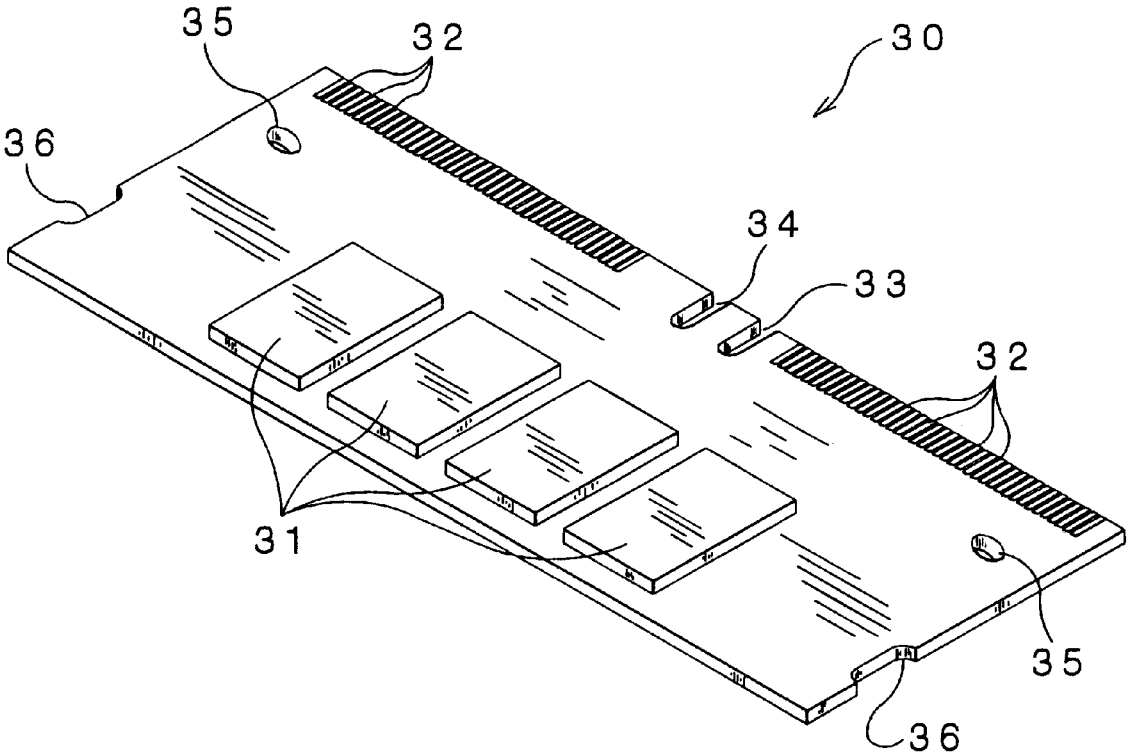
FIG. 3 is a perspective view of the memory module for the notebook-size computer to be loaded to the connector of FIG. 1.

A memory module 30 shown in FIG. 3 is of generally rectangular in plan configuration, and on both sides thereof a plurality of chips 31 including DRAM chips are mounted. The memory module has two key slots (uneven parts) 33, 34 around a center part thereof on the front side in the direction of its being inserted into the connector 1 and a large number of conductive pads 32 on front and back faces thereof at both lateral sides of the key slots. The key slot 33 is in the form of a recess having a semi-circular form at a tip end thereof The key slot 34 has the same size and configuration as the key slot 33.

The key slot 33 is formed for alignment of the memory module 30 and forms a reference for the memory module 30 to be loaded on a common memory module connector using the latches as described in the article of Prior Art. While in the illustrated embodiments, the key slots 33 formed in all the memory modules are taken not to vary in location and configuration, the key slots 33 may vary in location and/or configuration according to configurative features of the memory modules 30. The key slots 34 are formed for, for example, identifying operating voltages of the memory modules 30 and formed at different positions according to the operating voltages. The key slots 34 may vary in configuration and/or location according to the operating voltages.

Two circular holes 35 are formed at positions near areas in which the conductive pads 32 are arranged. Cutouts 36 are provided at opposite ends of the memory module 30, respectively. The cutouts 36 are for permitting the memory module 30 to be loaded to the connector having the latches.

Figure 4:
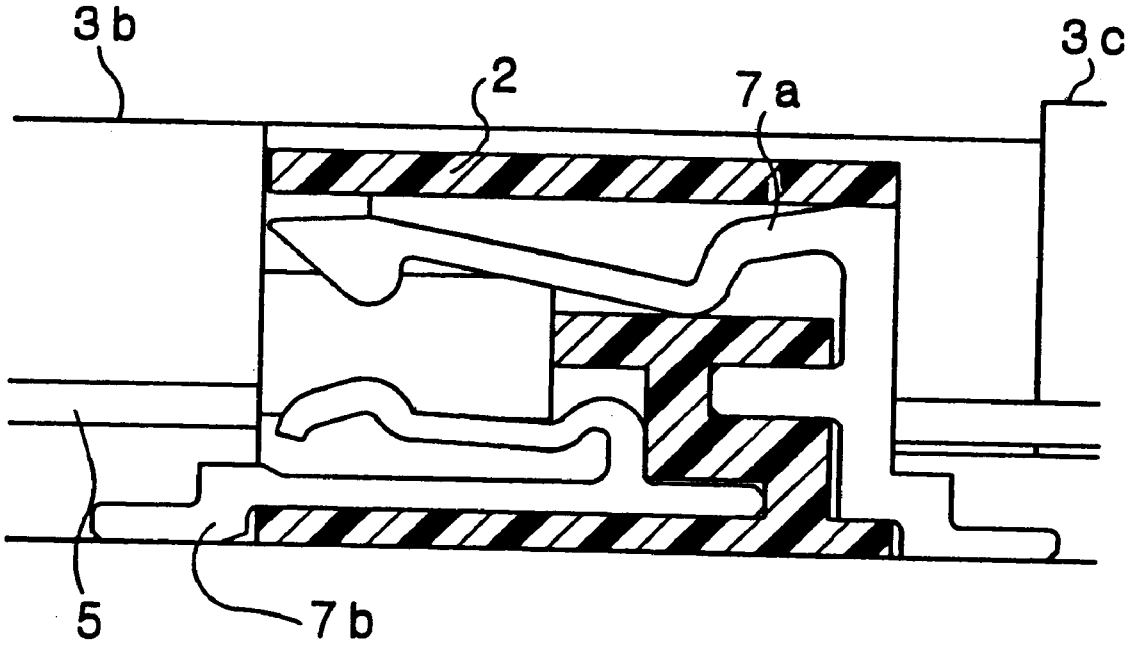
FIG. 4 is a sectional view of a portion of the connector of FIG. 1 near its housing.

Next, the structure of the connector 1 of this embodiment will be described with further reference to FIGS. 4–6. As shown in FIGS. 1 and 4, a large number of upper contacts 7*a* and lower contacts 7*b* made of metallic material are arranged at regular intervals in two separated areas of the housing 2 made of synthetic resin material, respectively. The upper contacts 7*a* and the lower contacts 7*b* are electrically connected with the conductive pads 32 when the memory module 30 is loaded to the connector 1. A key (a fitting part) 16 having a size and a configuration to fit in the key slot 33 is provided between the two areas, where the upper contacts 7*a* and the lower contacts 7*b* are arranged, at a position corresponding to the key slot 33 of the memory module 30.

The base 3 is composed of two spaced apart arms 3*a*, 3*b* and a connecting portion 3*c* connected with the two arms 3*a*, 3*b* at one end sides thereof. The arms 3*a*, 3*b* and the connecting portion 3*c* are both formed of synthetic resin material. The housing 2 is connected with the two arms 3*a*, 3*b* at a position close to the connecting portion 3*c*. The arms 3*a*, 3*b* have recesses 12 engageable with protrusions 11 mentioned later formed in their outside surfaces near the ends. The arms 3*a*, 3*b* have in their inside surfaces slots 13 extending along the extending direction of the arms 3*a*, 3*b*. End portions of the slider 5 are inserted in the slots 13 so that the slider 5 can slide in the slots 13. A hole is formed in the connecting portion 3*c* of the base 3 near the upper end, extending along the extending direction, and a shaft 14 is inserted in the hole.

Figure 5:
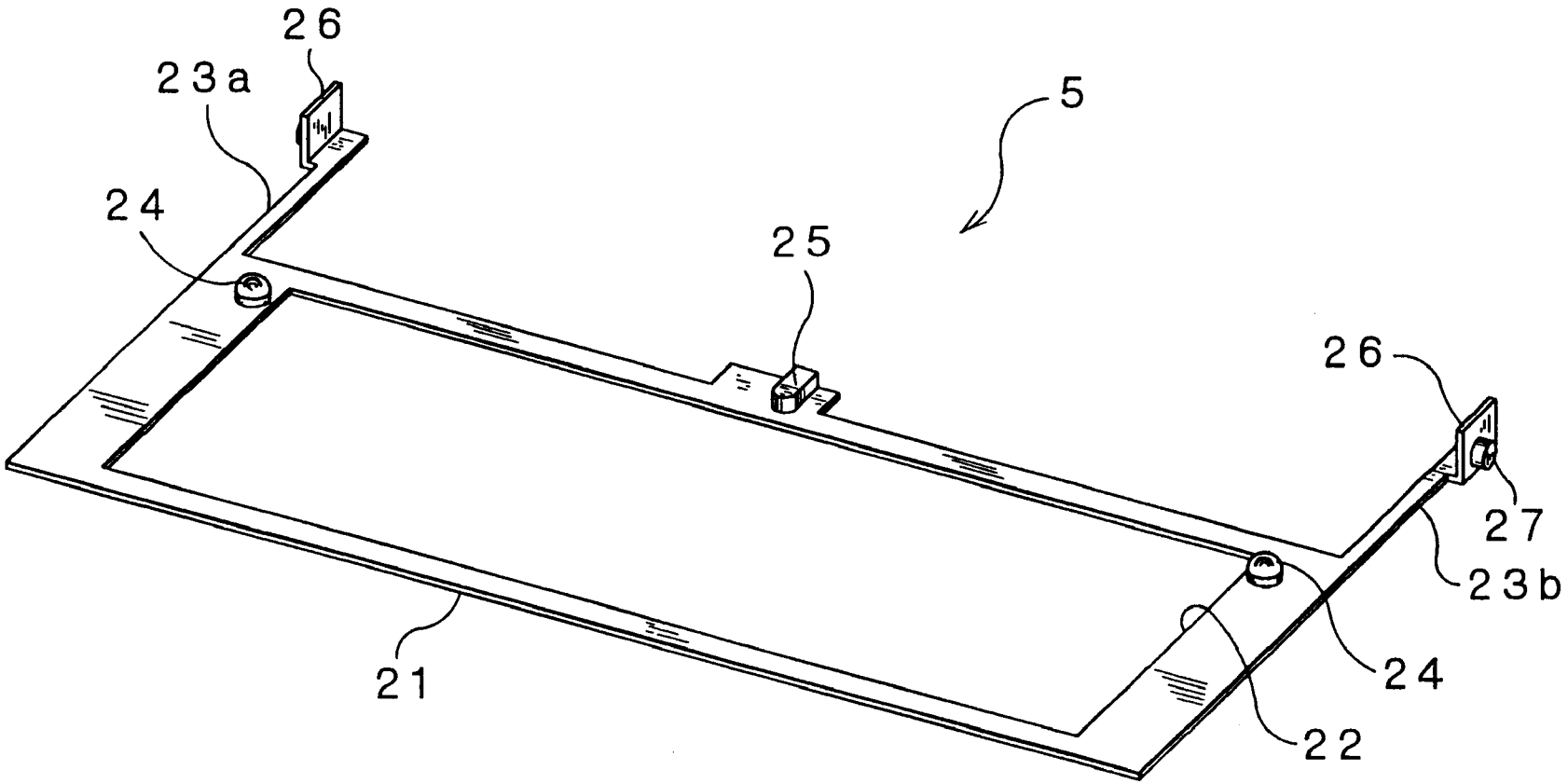
FIG. 5 is a perspective view of a slider used in the connector of FIG. 1.

As shown in FIG. 5, the slider 5 is provided with a rectangular frame 21 formed to surround an opening 22 and arms 23*a*, 23*b* extending from opposite ends of the frame 21 in the widthwise direction. The frame 21 has two projections 24 formed at positions corresponding to the holes 35 formed in the memory module 30. The insertion of the projections 24 in the holes 35 permits the memory module 30 to be detachably supported to the slider 5. An upper surface of the frame 21 forms a bearing surface for the memory module 30. Also, the frame 21 has a key (a fitting part) 25 having a size and configuration to fit in the key slot 34 and protruded from the bearing surface at a position corresponding to the key slot 34 of the memory module 30. The location where the key 25 is formed varies right and left according to the location where the key slot 34 of the memory module 30 is formed. The arms 23*a*, 23*b* have bent portions 26 bent upward at positions close to the ends and columnar protrusions 27 formed outside of the bent portions.

The cover 6 made of metallic material is formed to have a size to cover the whole area of the memory module 30 when the cover is closed, as shown in FIG. 2. The cover 6 is provided at both ends thereof with bent portions 10 bent toward the base 3, respectively. The bent portions 10 are provided at inside thereof with the protrusions 11 which are brought into engagement with the recesses 12 in the arms 3*a*, 3*b* of the base 3 when the cover 6 is closed.

Figure 6:
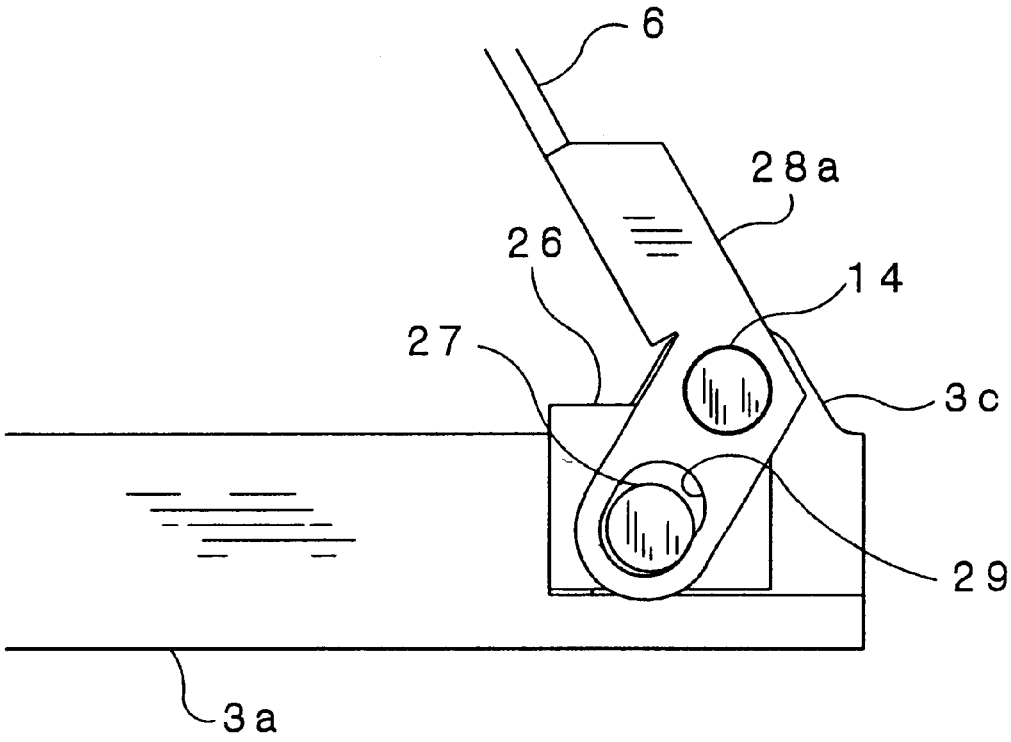
FIG. 6(*a*) is a side elevation view of a connecting portion of the connector of FIG. 1 at which the slider and the cover are connected together, showing the state of the cover being opened.
Figure 6:
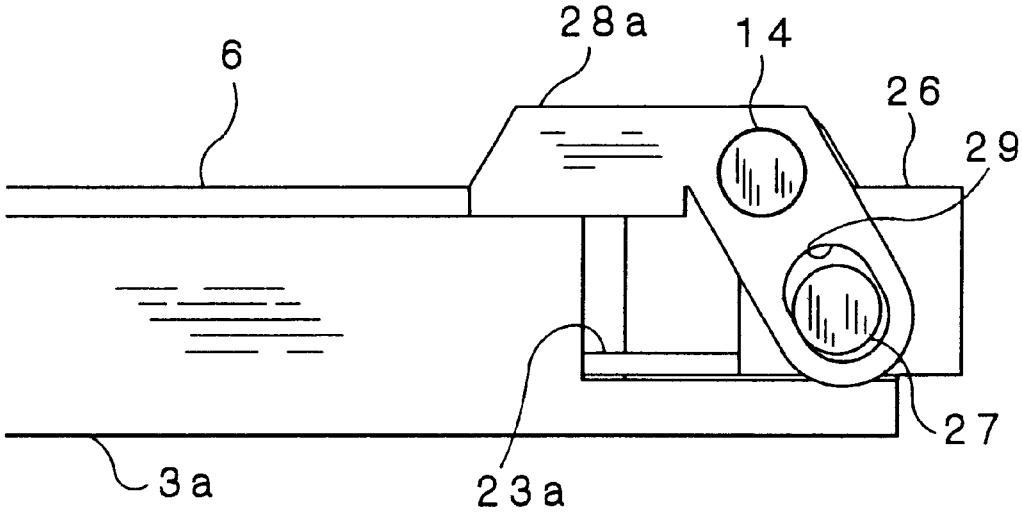

As shown in FIGS. 2, 6(*a*), 6(*b*), the cover 6 has two bent arms 28*a*, 28*b* which are bent inwardly toward the ends at portions thereof opposite the bent portions 10 at the both ends of the cover 6. The bent arms 28*a*, 28*b* are rotatably connected with the shaft 14 in a rotatable relation at portions thereof close to the bent portions. Thus, the cover 6 can be allowed to rotate around the shaft 14 in both directions. The bent arms 28*a*, 28*b* have generally elliptical holes 29 formed near the ends thereof. The columnar protrusions 27 of the slider 5 are fitted in the holes 29 and thereby the slider 5 and the cover 6 are rotatably connected.

Thus, when the cover 6 is rotated around the shaft 14 from its opened state shown in FIG. 6(*a*) until its closed state shown in FIG. 6(*b*), the bent arms 28*a*, 28*b* at portions between the ends thereof and the shaft 14 move rightward in the drawings, in association with which the columnar protrusions 27 are moved vertically in reciprocation within the holes 29, while rightward moving in the drawings. As a result, the slider 5 is moved toward the upper and lower contacts 7*a*, 7*b* in the housing 2. When the cover 6 is rotated around the shaft 14 from its closed state shown in FIG. 6(*b*) until its opened state shown in FIG. 6(*a*), the bent arms 28*a*, 28*b* at portions between the ends thereof and the shaft 14 move leftward in the drawings, in association with which the slider 5 moves away from the upper and lower contacts 7*a*, 7*b* in the housing 2. In short, the slider 5 is moved reciprocally with respect to the upper and lower contacts 7*a*, 7*b* in association with the rotation of the cover 6.

Next, the operation involved in the loading and unloading of the memory module 30 from the connector 1 of this embodiment will be described with further reference to FIGS. 7 and 8.

Figure 7:
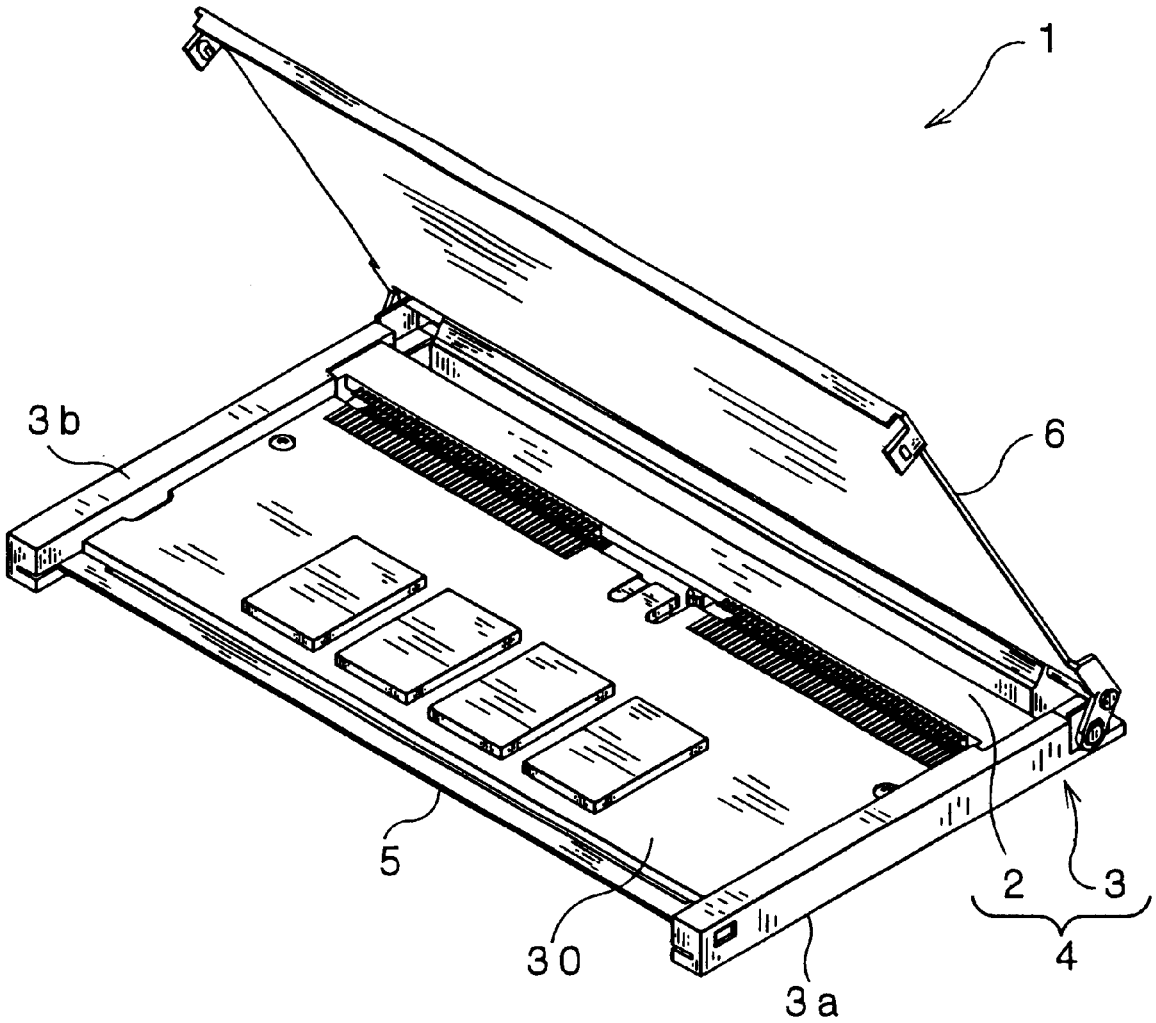
FIG. 7 is a perspective view of the connector of FIG. 1, showing the state in which the memory module is supported to the slider.

When the connector 1 of this embodiment is loaded with the memory module 30, the memory module 30 is put on the slider 5, with the cover 6 opened, so that it can be supported thereon, as shown in FIG. 7. At that time, the slider 5 is in its shifted position away from the housing 2, so that the memory module 30 can be put on the slider 5 with comparative ease. For putting the memory module 30 on and thus supported by the slider 5, it is only necessary that the projections 24 on the slider 5 are inserted into the holes 35 in the memory module 30. At that time, the memory module 30 is away from the housing 2 and the conductive pads 32 are not in contact with the upper and lower contacts 7*a*, 7*b*, as shown in FIG. 8(*a*). At the same time as the memory module 30 is supported on the slider 5, the key 25 of the slider is fitted in the key slot 34 of the memory module 30.

Figure 8:
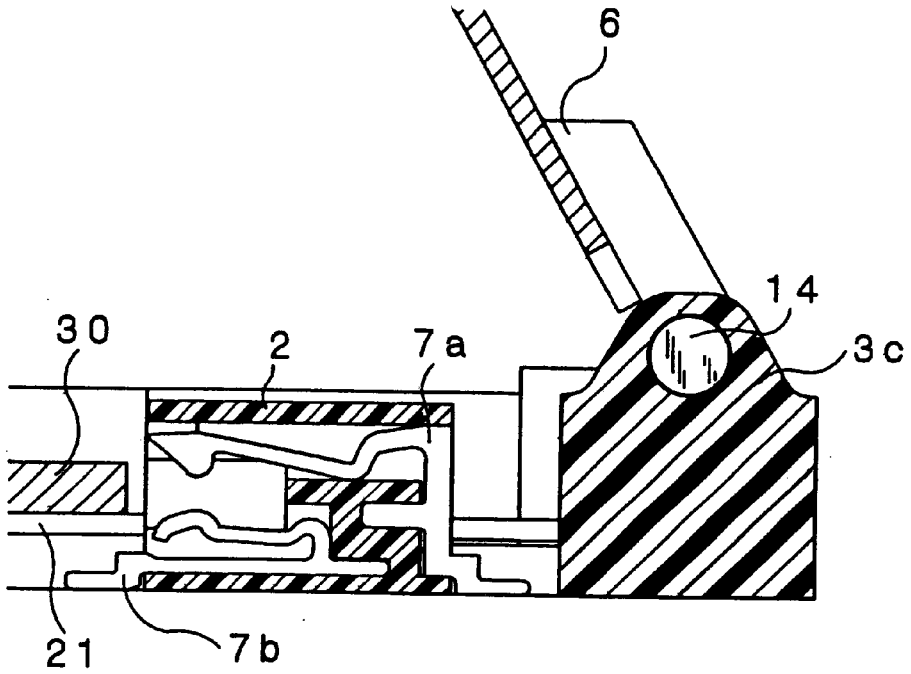
FIG. 8(*a*) is a sectional view of the portion of the connector of FIG. 1 near the housing, showing the state of the cover being opened.
Figure 8:
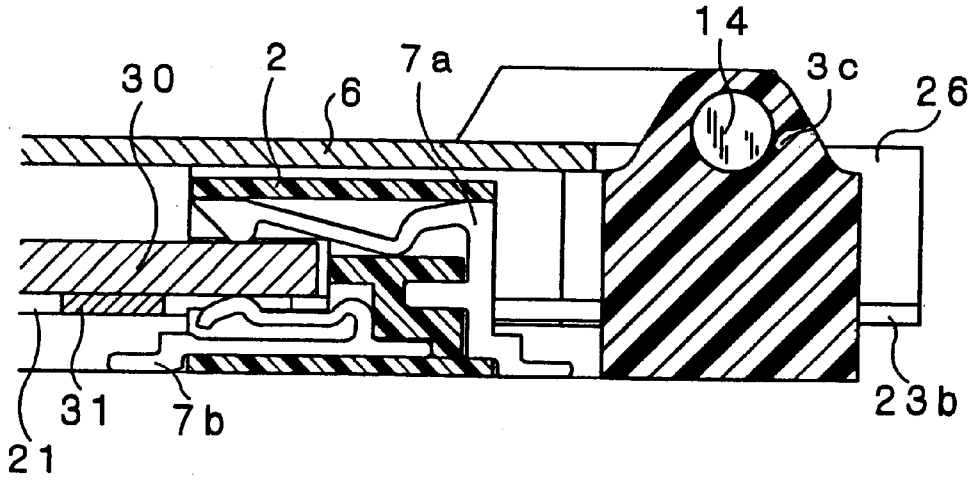

As the cover 6 is pushed down from the state of FIG. 8(*a*) to its closed state, the slider 5 is moved toward the upper and lower contacts 7*a*, 7*b* (rightward in the drawing), as mentioned above. As a result, a tip portion of the memory module 30 supported on the slider 5 is inserted into the housing 2 and is wedged between the upper and lower contacts 7*a*, 7*b*, as shown in FIG. 8(*b*). Thus, the conductive pads 32 provided on both sides of the memory module 30 are brought into contact with the upper contacts 7*a* and the lower contacts 7*b* and thereby the memory module 30 is connected with the upper contacts 7*a* and the lower contacts 7*b*. Immediately before this connection, the key 16 in the housing 2 is fitted in the key slot 33 of the memory module 30. Then, the cover 6 is closed, as shown in FIG. 2, and thereby the loading of the memory module 30 to the connector 1 is completed.

On the other hand, when the memory module 30 is unloaded from the connector 1, the cover 6 is opened from the state of FIG. 8(*b*). Then, the slider 5 is moved away from the upper and lower contacts 7*a*, 7*b* (leftward in the drawing). As a result, the memory module 30 supported by the slider 5 is put into the state in which they are not connected with the upper and lower contacts 7*a*, 7*b*, as shown in FIG. 7 and FIG. 8(*a*), and also the fitting engagement between the key slot 33 and the key 16 is released. In this state, the memory module 30 can be unloaded from the connector 1 with ease by simply picking up the memory module 30.

Thus, according to the connector 1 of this embodiment, since the slider 5 having the key 25 to fit in the key slot 34 formed in the memory module 30 at a location that differs according to the operating voltage is mounted on the main body 4, only the memory module 30 having the key slot 34 corresponding in position to the key 25 formed in the slider 5 can be loaded to the connector 1. Hence, the erroneous loading of the memory module 30 to the connector 1 can be prevented.

The key slot 33 is not varied in position even when the operating voltage of the memory module 30 varies, while on the other hand, the key slot 34 is varied in position when the operating voltage varies. Accordingly, as illustrated in the embodiment, the key 25 to fit in the key slot 34 is arranged on the slider 5 to share the structure of the main body 4 among all types of memory modules 30, whereby the memory module 30 that varies in operating voltage and location of the key slot 34 can be loaded to the connector 1 by simply replacing the slider 5 with another one having the key 25 to fit in the key slot 34. Thus, a relatively simple work of the replacement of the slider 5 is only required for the loading of the different types of memory modules 30. Thus, a variety of memory modules 30 can be loaded to the single connector 1 with easy operation.

According to this embodiment, since the slider 5 that moves reciprocally with respect to the contacts 7*a*, 7*b* in association with the rotation of the cover 6 can detachably support the memory module 30, the electrical connection between the memory module 30 and the contacts 7*a*, 7*b* is achieved by moving the slider 5 after the fitting engagement between the key slot 34 of the memory module 30 and the key 25 of the slider 5 has completed. In other words, the connection between the memory module 30 and the contacts 7*a*, 7*b* is not made until after the precise alignment of the memory module 30 is achieved by the fitting engagement between the key slot 34 and the key 25. This can ensure the reliable connection between the both.

Also, in this embodiment, the memory module 30 is connected to the contacts 7*a*, 7*b* by rotating the cover 6 after the memory module 30 is supported on the slider 5 in the state in which the cover 6 is opened. Thus, the manual operation of the cover 6 can permit the selective switching between the connected mode of the memory module 30 and the non-connected mode of the same in a simple manner. Also, there is no need for a user to directly touch the memory module 30 when the memory module 30 is switched between the connected mode and the non-connected mode, so that local application of an excessive force to the memory module 30 or the connector 1 may be avoided and, thus, the damage or deformation of these components can be prevented.

Further, according to this embodiment, the two keys 16, 25 to fit in the two key slots 33, 34 formed in the memory module 30 are separated and arranged one on each of the main body 4 and the slider 5. This can produce the result that after the fitting engagement of the key slot 34 of the memory module 30 and the key 25 of the slider 5, the slider 5 is moved toward the housing 2 and thereby the fitting engagement of another key slot 33 of the memory module 30 and the key 16 of the main body 4 can be achieved. As a result of this, it is only necessary for supporting the memory module 30 to the slider 5 to align the memory module 30 so that the fitting engagement of the key slot 34 of the memory module 30 and the key 25 of the slider 5 can be achieved. Also, before the fitting engagement of the key slot 33 of the memory module 30 and the key 16 of the housing 2, the memory module 30 is already put in the state of being aligned and supported on the slider 5. Thus, the fitting engagement of the key slot 33 and the key 16 can be achieved without the need for any additional alignment of the memory module 30. In short, the fitting engagements of the two key slots 33, 34 and the two keys 16, 25 are achieved in two separate steps, whereby the immediate and smooth fitting engagements of the key slots 33, 34 and the keys 16, 25 is ensured.

Also, the two keys 16, 25 are separated and arranged one on each of the main body 4 and the slider 5 and, thus, only a single key is formed on each of the housing 2 and the slider 5. This can produce the advantage that the fitting engagement of the key slots 33, 34 and the keys 16, 25 can easily be achieved without requiring high degree of manufacturing accuracy for the housing 2 and the slider 5 such that the keys 16, 25 can accurately be positioned, when compared with the manufacturing accuracy required for the two keys 16, 25 to be both formed in the housing 2.

Additionally, the connector 1 of this embodiment can provide the following advantages. Specifically, the connector 1 of this embodiment is designed to have such a simple structure that the cover 6 is supported by the shaft 14 to be rotated around it and also the slider 5 and the cover 6 are rotationally connected with each other at a position shifted from the shaft 14, whereby the slider 5 and the memory module 30 can be moved reciprocally with respect to the upper and lower contacts 7*a*, 7*b* in association with the rotation of the cover 6, to selectively switch between the connected mode and the non-connected mode of the memory module 30. Then, the loading of the memory module 30 to the connector 1 requires only two uneven parts that the memory module 30 is supported on the slider 5 and then the cover 6 is closed and entails no troublesome manipulation. The same applies to the unloading of the memory module 30 from the connector 1 as well. Also, since the memory module 30 can be loaded in place without applying a relatively large force to the memory module to press it in against the elasticity of coil springs, the loading work of the memory module can be performed with ease. Further, no elastic members such as coil springs are required, thus yielding a simplified structure and reduced manufacturing costs.

Also, in the connector 1 of this embodiment, when the memory module 30 is connected with the upper and lower contacts 7*a*, 7*b*, the whole area of the memory module 30 is covered with the cover 6, so that the memory module 30 can be protected from dust when connected therewith. Therefore, malfunction caused by loose connection or short circuit can be prevented effectively.

Since the cover 6 is made of metallic material, even when unwanted electromagnetic waves are produced from the memory module 30 or a connecting part between the memory module and the contacts 7*a*, 7*b*, it can shield the electromagnetic waves not to let them leak out. Also, since electromagnetic waves from outside can be shielded by the cover 6, the operation of the memory module 30 can be prevented from being adversely affected by the electromagnetic waves from outside.

Also, in the connector 1 of this embodiment, since the cover 6 is rotated around the shaft 14 extending substantially in parallel to the bearing surface for the memory module 30, the cover 6 does not protrude outside of a plane area defined by the cover 6 when the memory module 30 and the contacts 7*a*, 7*b* are contacted with each other (i.e., when the cover 6 is closed). Therefore, even when an extra space is not found at the outside of the plane area, the connection between the memory module 30 and the contacts 7*a*, 7*b* can be realized by rotating the cover 6.

Figure 9:
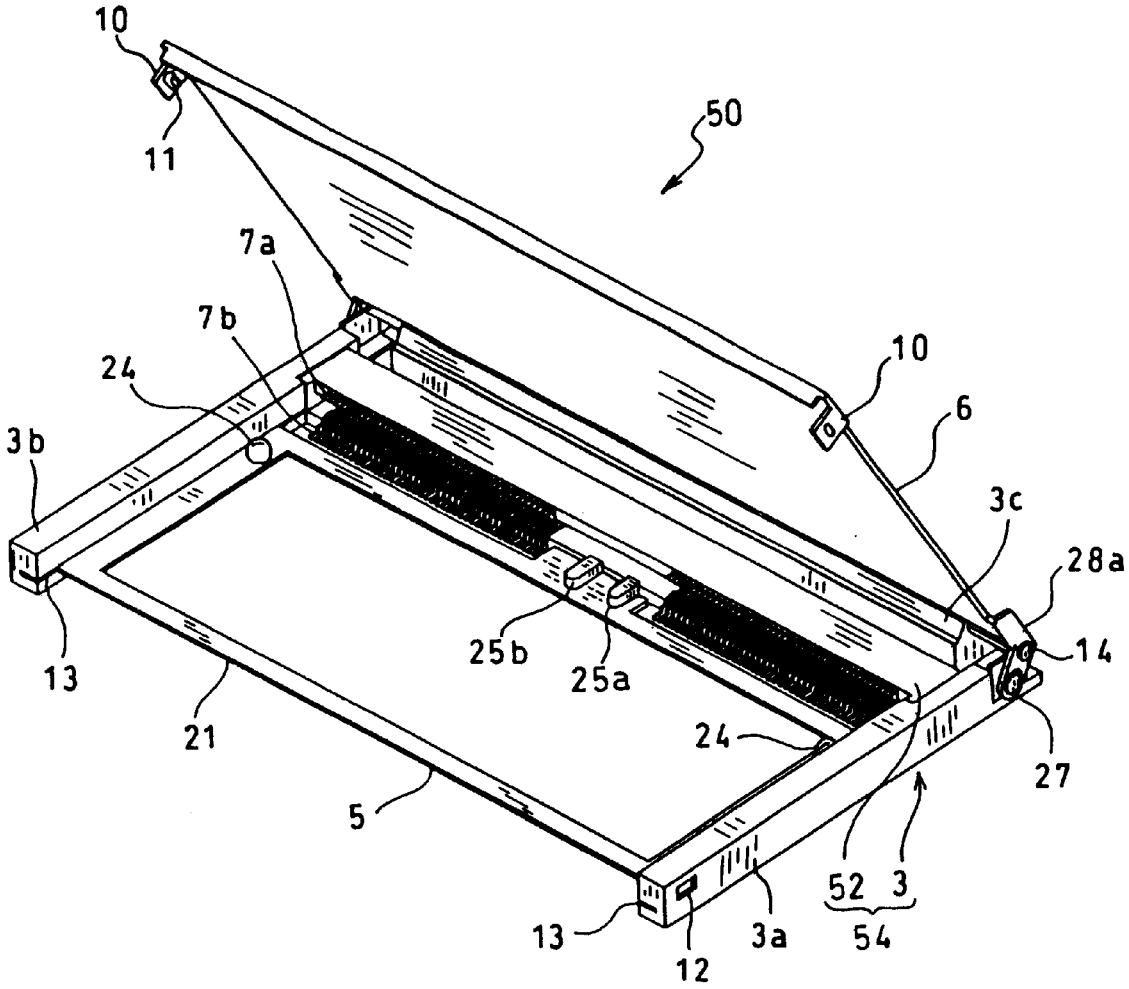
FIG. 9 is a perspective view of a connector according to the second embodiment of the invention to which a memory module for a notebook-size personal computer is loaded, showing the state of its cover being opened.

Referring now to FIG. 9, the second embodiment of the invention will be described next. It is to be noted that in this embodiment, common reference numerals refer to corresponding parts to those of the first embodiment, though description thereon will be omitted. The connector 50 shown in FIG. 9 is only different from the connector 1 shown in FIG. 1 in that two keys 25*a*, 25*b* are provided on the slider 51 and that the related key 16 shown in FIG. 1 is not arranged in the housing 52. The key 25*a* is formed at such a position as to fit in the key slot 33 of the memory module 30 and has a configuration to fit in the same key slot 33, and the key 25*b* is formed at such a position as to fit in the key slot 34 and has a configuration to fit in the same key slot 34.

The connector 50 of this embodiment can also provide substantially the same advantageous effects as those of the first embodiment of preventing erroneous loading of the memory module 30; of sharing the structure of the main body 54; and of ensuring the reliable connection between the memory module 30 and the contacts 7*a*, 7*b*. Further, in this embodiment, since no key is provided on the main body 54 and all the keys are provided on the slider 51, even when the location and/or the configuration of both of the key slots 33, 34 vary in accordance with the types of the memory modules 30 used, only the replacement of the slider 51 is needed to cope with it. This can provide the advantage of permitting the loading of even more types of memory modules 30.

Figure 10:
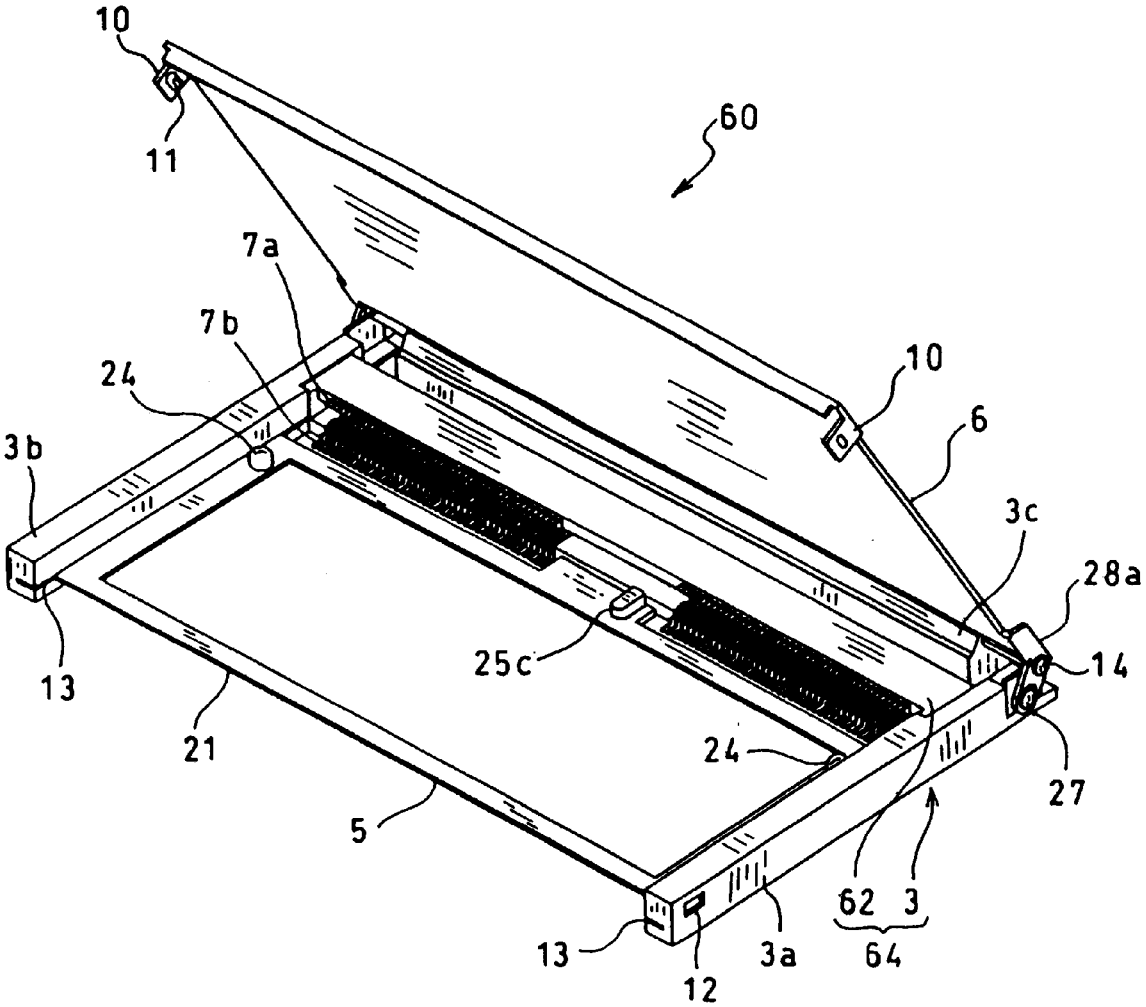
FIG. 10 is a perspective view of a connector according to the third embodiment of the invention to which the memory module for the notebook-size personal computer is loaded, showing the state of the cover being opened.
Figure 11:
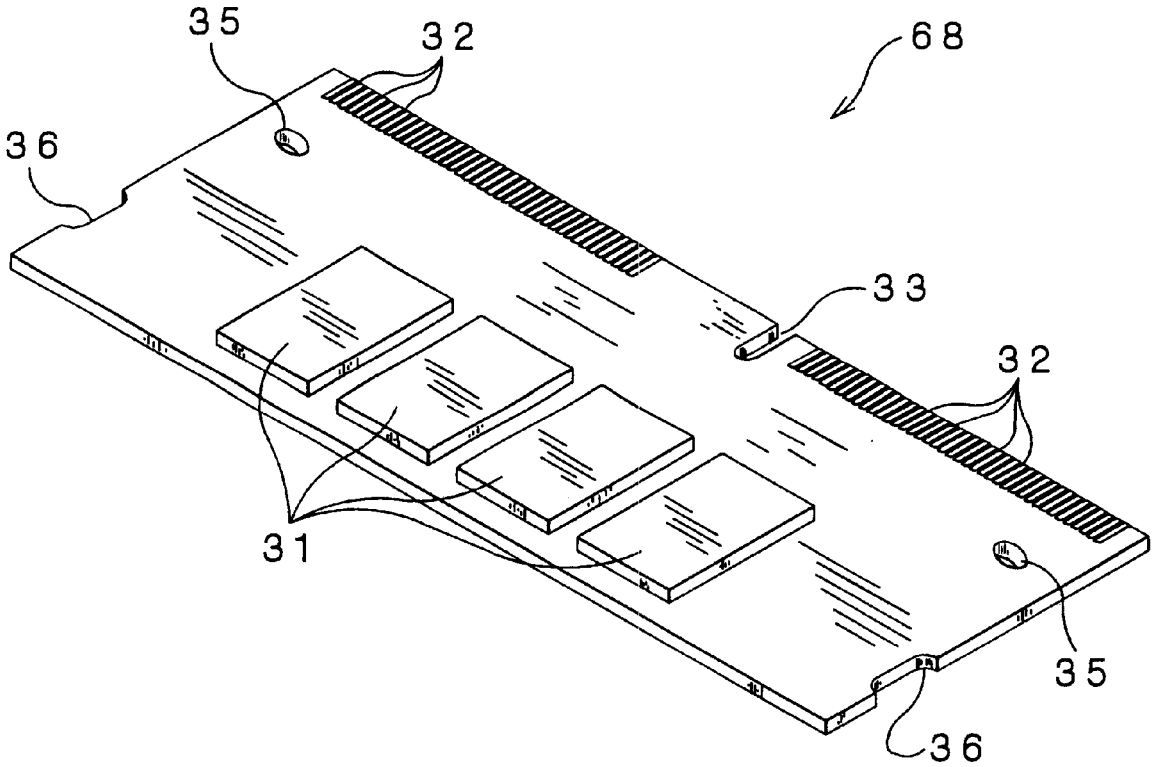
FIG. 11 is a perspective view of the memory module for the notebook-size personal computer to be loaded to the connector of FIG. 10.

Referring further to FIGS. 10 and 11, the third embodiment of the invention will be described next. It is to be noted that in this embodiment, common reference numerals refer to corresponding parts to those of the first embodiment, though description thereon will be omitted.

A memory module 68 shown in FIG. 11 is only different from the memory module 30 shown in FIG. 3 in that it has only a single alignment-use key slot 33. A connector 60 of this embodiment is only different from the connector 1 shown in FIG. 1 in that it has a key 25*c* formed at such a position as to fit in the key slot 33 and has a configuration to fit in the same key slot 33 and that the key 16 shown in FIG. 1 is not arranged in the housing 52.

The connector 60 of this embodiment can also provide substantially the same advantageous effects as those of the first embodiment of preventing erroneous loading of the memory module 68; of sharing the structure of the main body 64; and of ensuring the reliable connection between the memory module 68 and the contacts 7*a*, 7*b*. The structure of this embodiment and a like structure is effective for the memory module 68 having only the single key slot 33 as shown in FIG. 11.

While there have been described certain preferred embodiments of the invention, various design changes and modification may be made within the scope of the claimed invention without limiting to the illustrated embodiments. For example, three or more keys may be arranged on the connector to accommodate the memory module having three or more key slots. In this modification, it is preferable that at least one key is arranged on the slider, as mentioned above. While in the illustrated embodiments, the slider that moves reciprocally with respect to the contacts is allowed to support the memory module thereon, the slider may be replaced by a member forming thereon a key to fit in the key slot of the memory module being detachably mounted in the housing. Also, such a modification may be made that the key (protrusion) is arranged on the memory module, while also the key slot (recess) is arranged on the main body.

What is claimed is:

1. A connector for electrically connecting a connection object and a terminal, said connector comprising:

a main body;

said terminal, arranged at said main body, to be electrically connected with said connection object having at least one uneven part which varies in at least one of location and configuration in accordance with the types of the connection object; and an auxiliary member mounted on said main body and having at least one fitting part which varies in at least one of location and configuration in accordance with the types of the corresponding connection object to fit to the respective of said at least one uneven part of said connection object; and an operating member hinged to said main body and connected to said auxiliary member through an elliptical hole, and in which said auxiliary member adapted to detachably support said connection object and to move reciprocally relative to said terminal in association with movement of said operating member.

2. A connector according to claim 1, wherein two or more fitting parts to fit to their related two or more uneven parts formed in said connection object are separately arranged so that each of said main body and said auxiliary member has at least one fitting part.

* * * * *